US007895936B2

(12) United States Patent
Hofbauer

(10) Patent No.: US 7,895,936 B2
(45) Date of Patent: Mar. 1, 2011

(54) PISTON WITH A LIGHTWEIGHT CONSTRUCTION THAT IS SUBJECTED TO HIGH THERMAL STRESS

(75) Inventor: Peter Hofbauer, West Bloomfield, MI (US)

(73) Assignee: Advanced Propulsion Technologies, Inc., Goleta, CA (US)

( * ) Notice: Subject to any disclaimer, the term of this patent is extended or adjusted under 35 U.S.C. 154(b) by 517 days.

(21) Appl. No.: 11/720,415

(22) PCT Filed: Nov. 8, 2005

(86) PCT No.: PCT/EP2005/011898

§ 371 (c)(1), (2), (4) Date: Aug. 15, 2007

(87) PCT Pub. No.: WO2006/056315

PCT Pub. Date: Jun. 1, 2006

(65) Prior Publication Data

US 2008/0134879 A1 Jun. 12, 2008

(30) Foreign Application Priority Data

Nov. 26, 2004 (DE) ..... 10 2004 057 284

(51) Int. Cl.
*F02F 3/00* (2006.01)
*F02F 3/22* (2006.01)

(52) U.S. Cl. ..... 92/186; 92/159

(58) Field of Classification Search ..... 92/159, 92/186, 190, 216, 219, 231; 123/41.35
See application file for complete search history.

(56) References Cited

U.S. PATENT DOCUMENTS

| | | | | | |
|---|---|---|---|---|---|
| 2,124,360 | A | * | 7/1938 | Welty | 92/222 |
| 2,349,919 | A | * | 5/1944 | Starr | 92/257 |
| 3,319,536 | A | * | 5/1967 | Kohl et al. | 92/186 |
| 3,805,677 | A | * | 4/1974 | Clary et al. | 92/186 |
| 4,072,088 | A | * | 2/1978 | Goloff | 92/220 |
| 4,375,782 | A | | 3/1983 | Schieber et al. | |
| 4,506,632 | A | * | 3/1985 | Kanda et al. | 92/186 |
| 4,553,472 | A | | 11/1985 | Munro et al. | |
| 4,592,268 | A | * | 6/1986 | Hartsock | 92/213 |
| 4,651,631 | A | | 3/1987 | Avezou et al. | |
| 5,052,280 | A | * | 10/1991 | Kopf et al. | 92/186 |
| 5,119,777 | A | * | 6/1992 | Mielke et al. | 123/193.6 |
| 5,169,462 | A | | 12/1992 | Morley et al. | |
| 6,056,536 | A | * | 5/2000 | Schad et al. | 425/562 |

FOREIGN PATENT DOCUMENTS

| | | |
|---|---|---|
| JP | 02157461 | 6/1990 |
| SU | 791983 | 2/1981 |

* cited by examiner

*Primary Examiner* — Thomas E Lazo

(57) ABSTRACT

The invention relates to a piston of an internal combustion engine comprising an upper part (1) and a lower part (3) that consist of a respective light metal alloy (15) and to an associated method for increasing the thermal load-bearing capacity of a multi-part piston that is subjected to high thermal stress in an internal combustion engine. The piston is provided with at least one insulating element, in particular a gap (7) between the lower part (3) and the upper part (1), at least one piston ring carrier (6), which consists of a different material from that of the upper part (1) and the lower part (3), in particular of steel or grey cast iron, being located next to said gap as a component. A thermal current that is introduced into the piston base (2) is prevented from dissipating via the piston ring carrier (6) by means of the insulating element.

23 Claims, 4 Drawing Sheets

PISTON WITH A LIGHTWEIGHT CONSTRUCTION THAT IS SUBJECTED TO HIGH THERMAL STRESS

CROSS-REFERENCE TO RELATED APPLICATIONS

This application claims priority of PCT Application No. PCT/EP2005/011898 filed Nov. 8, 2005, which claims priority of German Application No. DE 10 2004 057 284.4 filed Nov. 26, 2004, which are both incorporated herein by reference.

FIELD OF THE INVENTION

The invention pertains to a piston for an internal combustion engine with an upper part and a lower part, each made from a light metal alloy, as well as to associated methods.

BACKGROUND OF THE INVENTION

Particularly under a high thermal stress, a lightweight-construction piston requires that thermal stress limits be met.

The problem of the present invention is to improve a thermal maximum stress capacity of a highly thermally-stressed piston for an internal combustion engine and to also provide a lightweight construction.

SUMMARY OF THE INVENTION

The problem of improving a thermal maximum stress capacity of a highly thermally-stressed piston is solved according to the invention by a piston according to claim 1, a method for the assembly of a piston according to claim 11, and a method for influencing a heat dissipation according to claim 14. Favorable arrangements and refinements are specified in the respective dependent claims.

In a piston according to the invention for an internal combustion engine, preferably constructed from several parts, with an upper part and a lower part each consisting of a light metal alloy, the upper part and lower part are connected such that at least one insulating element is present between the lower part and the upper part adjacent to which element at least one piston ring carrier made from a material other than that of the upper part and lower part, in particular from steel or grey cast iron, is arranged as a component and holds at least one piston ring.

The upper part comprises, in particular, a piston head. The lower part comprises, in particular, a piston skirt. The piston ring carrier is preferably accommodated in a recess or a groove in the lower part. Alternatively the piston ring carrier is inserted between the upper and the lower part. The lower part preferably also comprises several piston ring carriers. A ring held in a piston ring carrier is, in particular, a familiar sealing ring.

In order to achieve a lightweight construction it is provided that the light metal alloy comprises aluminum and/or beryllium and/or magnesium. For example, the light metal alloy contains aluminum and/or beryllium as the principal constituents, and additional constituents of, for example, magnesium and/or copper and/or silicon and/or nickel and/or zinc. The parts by weight preferably lie between 70 and 100% for aluminum, between 0 and 30% for silicon, between 0 and 15% for magnesium, between 0 and 15% for copper, between 0 and 10% for zinc as well as between 0 and 10% for nickel. Alternatively, the light metal alloy preferably contains a principal constituent of beryllium, between 60 and 100% beryllium, with between 0 and 40% aluminum and/or copper and/or silicon and/or nickel. Alternatively, the light metal alloy preferably contains a principal constituent of magnesium as well as additional constituents of, in particular, aluminum and/or copper and/or silicon and/or nickel. The parts by weight preferably lie between 70 and 100% for magnesium, between 0 and 30% for silicon, between 0 and 20% for aluminum, between 0 and 15% for copper, between 0 and 10% for zinc, as well as between 0 and 10% for nickel. The same light metal alloy is preferably used for the upper and the lower part of the piston. Particularly to meet special material requirements, however, different light metal alloys can be used for the upper and the lower part.

The insulating element can be realized in various ways. In particular, the insulating element has a lower thermal conductivity than the light metal alloy used for the piston. For example, the insulating element made of ceramic is manufactured, in particular, from zirconium oxide ceramics. For example, the insulating element is manufactured from a titanium-containing metal or steel. Additionally the insulating element is manufactured from a foamed metal or one with a microporous filling (e.g.: microporous silica).

In a preferred arrangement the insulating element is a gap. Various arrangements of the gap are described below, although an insulating element, particularly one made from one of the aforementioned materials, can be used correspondingly in place of a gap.

The gap between the upper and the lower part can be constructed in various ways. Preferably the gap is constructed such that thermal insulation is achieved between the piston head and the piston ring carrier. For this purpose, the gap is constructed, for example, radially between the piston head and the piston ring carrier relative to an axial main direction of the piston. In a different manner, only a radial component of the gap can run diagonally or irregularly diagonally. In particular the gap can run up to the piston skirt surface. Preferably the gap extends through the piston skirt surface, so that the gap opens outward. Alternatively or additionally, a gap is constructed in the axial direction. An axial component of the gap preferably extends in this case from the piston head to the region of the piston ring carrier. Here, as well, only an axial component of the gap can run diagonally or irregularly diagonally. In a preferred arrangement, a compound gap composed of a radial and an axial section is used. For example, the gap forms a cylinder ring which is expanded laterally outward, in particular at a right angle, in its upper area. In another variant several gap arrangements are combined.

In particular, such an arrangement of an insulating element, in particular a gap, makes it possible to limit a temperature of the piston ring carrier and thus of a piston ring held therein in order to minimize, for example, wear of the piston ring carrier.

For an alternative or additional influence on a heat transport in the piston, at least one thermally insulating ring, for instance, is arranged between the upper part and a piston ring carrier and/or a lower part. The thermally insulating ring is arranged, for example, in the lower part, between the piston ring carrier and the upper part. The piston ring carrier is accommodated in a groove or a recess, for example. In another arrangement, the thermally insulating ring is accommodated in the upper part. For example, the thermally insulating ring is arranged in a groove or a recess here as well. Preferably the thermally insulating ring is used in place of a part of a radial gap section. In particular, a thermally insulating ring increases the mechanical stability of a two-part or multipart piston construction designed with a gap. Different variants can be used to achieve a thermal insulation effect of the ring. In a first variant, a thermally insulating ring made of a material with a low thermal conductivity is used. In particular, it is provided that a material for the production of the thermally insulating ring comprises titanium. Preferably a titanium alloy which, like titanium, has a smaller thermal conductivity than that of the light metal alloy used for the piston, is alternatively employed. In another design the thermally insulating ring is manufactured from a ceramic. Preferably a zirconium oxide ceramic is used.

In a second variant a ring implemented as a hollow body is used. In a modification, a thermally insulating ring with a U-shaped and thus an open cross section can also be used. Just as when using a hollow body, the thermal conductivity is reduced by an air gap. At the same time however, the thermally insulating ring allows an increased mechanical stability of the piston construction compared with an ordinary gap. A metal, preferably titanium or a titanium-containing alloy, is particularly preferred as the material for a ring of the second variant Alternatively, a ceramic, preferably a zirconium oxide ceramic, can be used.

For a connection of the upper part and the lower part, it is provided that the upper part is screwed to the lower part. Preferably, the upper part and the lower part are constructed in the area of the threaded connection such that the upper part can be arranged as an inner piston skirt concentrically inside an outer piston skirt of the lower part.

In another variant the upper part is welded to the lower part. A resistance welding method, for instance, or welding with a laser or electron beam is used for this purpose. Friction welding of the upper and lower parts, which are rotationally symmetric in the area of the weld, is particularly economical.

For improved cooling of the piston, a cooling chamber through which a coolant can flow is used; its lower delimitation is a delimitation element, in particular, a metal sheet arranged below a piston head on a side facing away from a combustion chamber. Preferably, oil flows through the cooling chamber. Another coolant can also be used, however. For instance, a coolant is injected for cooling via an entrance opening into the cooling chamber. Preferably at least one outlet is provided from which the coolant used for the cooling can exit from the cooling chamber. In particular, the metal sheet can be stamped in special form, for example in a meander or other form for directing a coolant flow, or can comprise cooling ducts. The metal sheet is preferably mounted by means of clamping, especially preferably between the lower part and the upper part of the piston. In another arrangement the metal sheet is clamped in underneath the piston head by its own spring tension. For this purpose, the metal sheet is jammed, for example, into a groove provided for it. Cooling with a coolant can be realized in this way with a lightweight and easily produced component.

In a preferred arrangement the cooling chamber is in one piece. Thus the cooling chamber does not contain an internal delimitation for the coolant. Moreover, the one-piece cooling chamber is easy to realize. In the one-piece design as well, a continuous exchange of coolant is preferably provided by means of an inlet opening and an outlet opening.

In accordance with another concept of the invention, it is provided in a method for the assembly of a piston that the upper part and lower part are put together and joined, with at least one thermally insulating ring and/or at least the piston ring carrier clamped between them. In particular, a simple method for an easy assembly is thereby made available. A piston ring carrier or a thermally insulating ring is placed, for example, in a recess in the lower part and with an upper part subsequently placed upon it clamped between the upper part and the lower part. Alternatively, a piston ring carrier or a thermally insulating ring is placed in, for example, a recess in the upper part and with the lower part placed upon it accordingly clamped between the upper and the lower part. In particular, several rings, several piston ring carriers, for example, or a thermally insulating ring and a piston ring carrier or several thermally insulating rings are analogously clamped.

In a particularly favorable arrangement, at least one piston ring carrier and/or one thermally insulating ring are shrink-fit on a piston skirt. For example piston ring carriers and/or a thermally insulating ring as well as the piston skirt are cooled down and in the cooled down state the piston ring carriers and/or the thermally insulating ring are pushed onto the piston skirt, for example into a recess. When these are warmed to ambient temperature a fixed connection is created by the different linear coefficients of expansion. The linear coefficient of expansion in this case is, for example, on the order of $22\times10^{-6}$/K, in particular between $15\times10^{-6}$/K and $30\times10^{-6}$/K, for an aluminum alloy, whereas for grey cast iron it is only roughly $10\times10^{-6}$/K, in particular between $5\times10^{-6}$/K and $15\times10^{-6}$/K.

A method for the assembly of a piston is provided for producing the cooling chamber. The upper part and lower part are put together and connected, a metal sheet being clamped below the head on a side of a piston head facing away from the combustion chamber such that a cooling chamber with a coolant flowing through it is formed. Preferably the metal sheet is inserted into the piston skirt onto a projection there and subsequently clamped between the upper and the lower part with the upper part placed upon it. With an appropriate design, the upper and the lower part can be interchanged analogously. In particular, easy assembly is made possible in this way. Preferably, this method for assembly can be combined with the method for assembly described above in which a piston ring carrier and/or a thermally insulating ring are clamped in. In particular, both the metal sheet and the piston ring carrier and/or a thermally insulating ring can be assembled in one assembly process at the same time as the joining of the upper and lower part of a piston.

In accordance with a further concept of the invention, a method is provided for influencing a heat dissipation of an internal combustion engine piston that comprises an upper part and a lower part, each made from a lightweight alloy, in which method a heat flow introduced in a combustion process into a piston head is prevented, by means of at least one insulating element, in particular a gap in the piston, particularly between the upper and lower part, from flowing off via at least one piston ring carrier with at least one piston ring accommodated therein into a cylinder associated with the piston. In particular, a heat path is interrupted by the insulating element with its preferably very low thermal conductivity. This method preferably allows limitation of a temperature of the piston ring carrier and thus of the piston ring. In particular, the insulating element is arranged in such a way that a heat path from the piston head to the piston ring carrier is interrupted.

In a refinement of this method, the heat flow introduced into the piston head is additionally prevented, by means of at least one thermally insulating ring, from flowing off via the piston ring carrier with the piston ring held therein into a cylinder assigned to the piston. In particular this ensures an increased thermal resistance in the direction of the heat path from the piston head to the piston ring carrier.

In accordance with a further concept it is provided that at least one part of the heat flow introduced into the piston head is led by means of the insulating element, in particular the gap, into a cooling space arranged underneath the piston head.

For example, the insulating element represents a periphery of a heat path, so that it becomes possible to direct the heat flow.

In this way it is possible, in particular, to expose certain regions of the piston, preferably the area of the piston ring carrier, to a smaller temperature stress. It is particularly preferred for the heat flow to be conducted into the cooling space, for example, an oil cooling space, where a particularly good removal of the heat is possible.

BRIEF DESCRIPTION OF THE DRAWINGS

The invention will be presented below, by way of example, on the basis of drawings. The characteristics there are not limited to the respective construction however. Rather, the characteristics indicated in the drawings and the specification, including the descriptions of figures, can be combined and developed further.

DETAILED DESCRIPTION OF THE PREFERRED EMBODIMENTS

Figure 1:
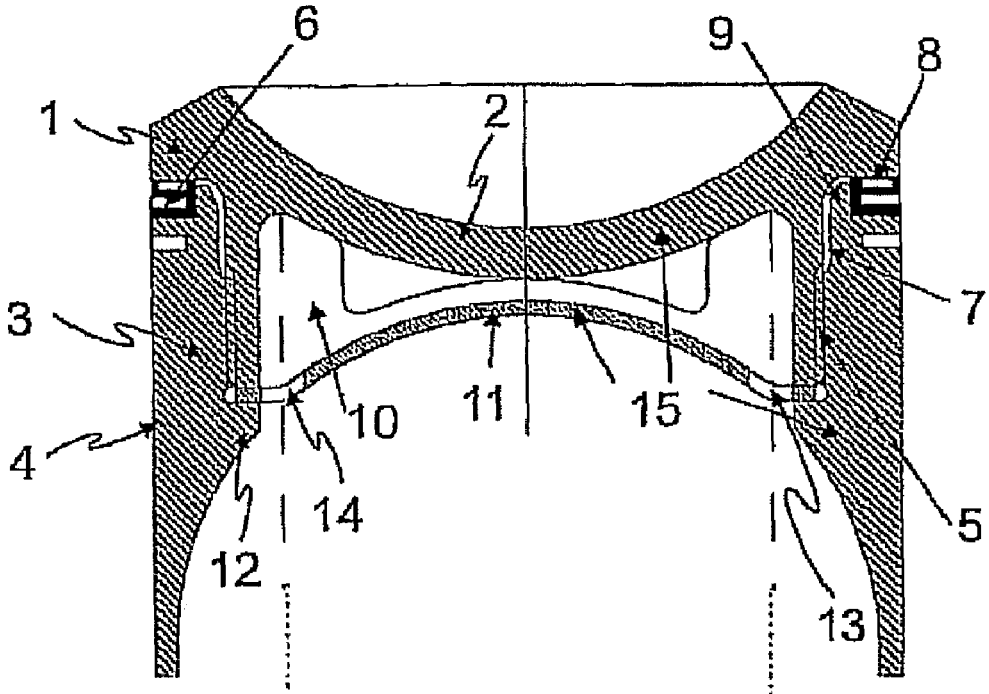
FIG. 1 shows a profile of a first piston.

FIG. 1 shows a profile of a first piston. The longitudinal section shown in FIG. 1 is a section along a main axis of the piston. Moreover, the cut is made along a piston pin axis, so that the pin bosses of the piston are not visible in the section shown.

The piston comprises an upper part 1 that comprises a piston head 2 as well as a lower part 3, which comprises a piston skirt 4. Upper part 1 and lower part 3 are fastened with a connection 5. Connection 5 is implemented in this example as a threaded connection. However a welded joint or a subsequently welded threaded connection can also be used.

Between upper part 1 and lower part 3 there is a gap 7 in the area of a piston ring carrier 6. The gap 7 extends parallel to the piston skirt 4 in a first section, so that the gap 7 in this section forms a cylindrical-ring-shaped gap. In a second section, the gap 7 is formed radially, so that it separates upper part 1 with piston head 2 from lower part 3 with piston ring carrier 6. A thermally insulating ring is arranged in this second area of gap 7. Thermally insulating ring 8 thus separates piston ring carrier 6 from piston head 2. Thermally insulating ring 8 is formed in this example with a rectangular, downward-open U-shaped cross section, so that an air gap results. An appropriate recess 9 is provided in piston skirt 4 to accommodate piston ring carrier 6 and thermally insulating ring 8 in piston skirt 4. The piston ring carrier and/or the thermally insulating ring are fixed, for instance, by shrink-fitting.

For improved heat dissipation, an oil cooling space 10 is provided underneath piston head 2. A lower limitation of an oil cooling chamber is formed by a metal sheet 11 clamped between a projection 12 of piston skirt 4 and upper part 1. A first opening 13 and a second opening 14, respectively, are provided for inflow and outflow of the oil. In the example shown, these openings are realized by drill holes. In operation, oil is injected through first opening 13. The injected oil distributes itself on the lower surface of the piston head 2 and runs back out via the second opening and/or the first opening.

A light metal alloy 15 is used as the material for upper part 1, lower part 3 and metal sheet 11. Piston ring carrier 6 is manufactured from grey cast iron and thermally insulating ring 8 is manufactured from titanium.

Below, identically functioning elements are provided with identical reference symbols and designations.

Figure 2:
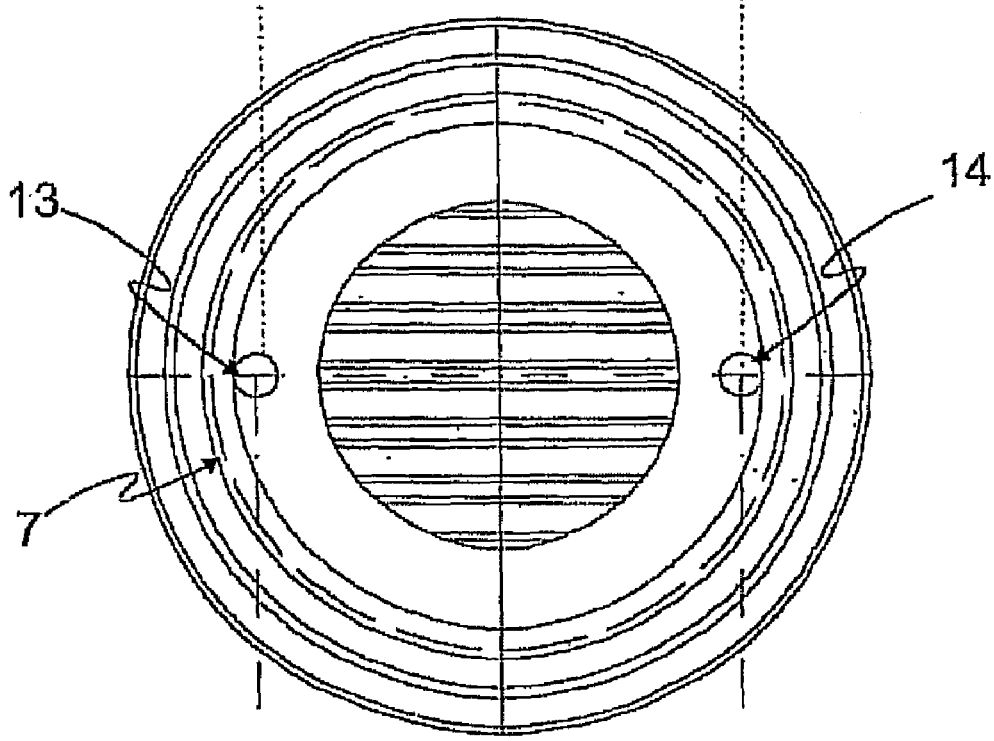
FIG. 2, an axial projection of characteristic radii of the first piston.

FIG. 2 shows an axial projection of the characteristic radii of the first piston. The projection is made here in the axial main direction of the first piston shown in FIG. 1. It is noted here that this is not a cut, but only a projection of characteristic radii of different design features. In particular, this representation shows the axial component of gap 7, which is reproduced as a cylindrical ring in the projection here. The projections of first opening 13 and second opening 14 for inflow and outflow of oil can also be seen.

Figure 3:
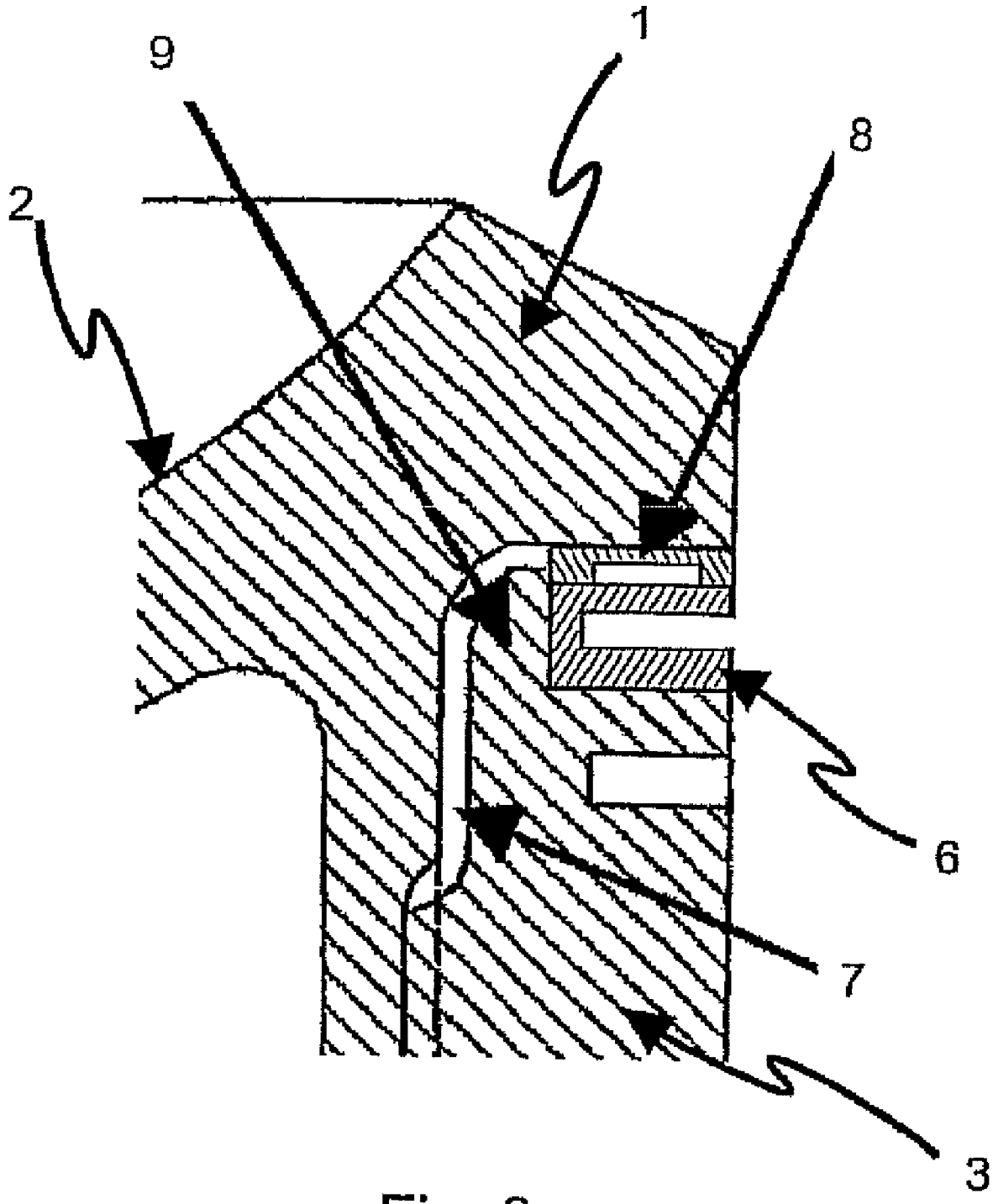
FIG. 3, an area of a piston ring carrier of a piston.

FIG. 3 shows an area of the piston ring carrier of the first piston shown in FIG. 1. Gap 7 is situated between upper part 1, which comprises piston head 2, and lower part 3 of the piston. Piston ring carrier 6 and thermally insulating ring 8 are inserted into recess 9. Thermally insulating ring 8 is furnished with a U-shaped, downward-open cross section.

Figure 4:
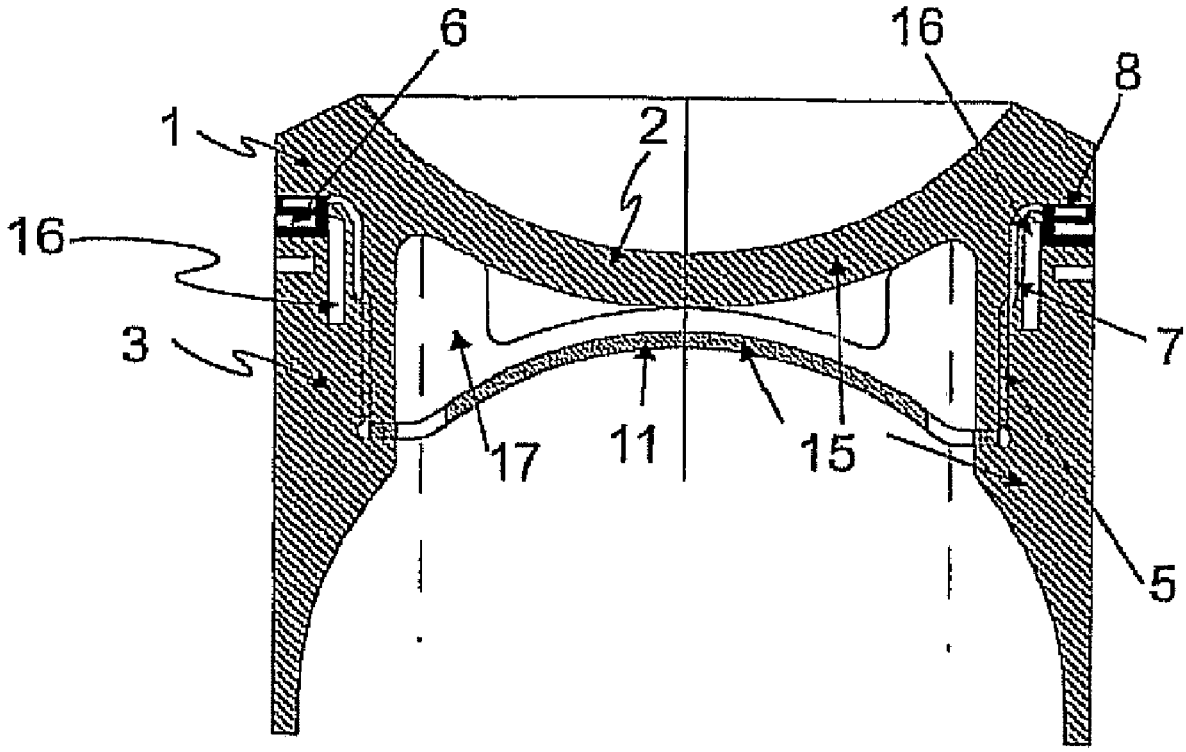
FIG. 4, a profile of a second piston.

FIG. 4 shows a longitudinal section of a second piston. The second piston substantially corresponds to the first piston shown in FIG. 1, but in contrast thereto it comprises a second oil cooling space 16. This second oil-cooling space 16 is arranged between a piston ring carrier 6 and a gap between upper part 1 and lower part 3 of the piston. It is directly behind piston ring carrier 6, so that the latter can be directly oil-cooled. Second oil-cooling space 16 is independent of a first oil-cooling space 17, which is formed underneath a piston head 2 by a delimiting metal sheet 11. Greatly improved temperature control of piston ring carrier 6 is achieved, in particular, by second oil-cooling space 16. Contrary to the representation shown here, the oil-cooling space can also be designed such that it includes or replaces gap 7. Second oil-cooling space 16 can likewise be designed so that direct cooling of the thermally insulating ring 8 is possible. Second oil-cooling space 16 can also extend further downward into the area of a connection between upper part 1 and lower part 3 of the piston. In the example shown, second oil-cooling space 16 is formed by a cavity in lower part 3, which is manufactured from a light metal alloy 15. Alternatively, the cavity is formed between two parts of the piston, for example between upper part 1 and lower part 3.

Figure 5:
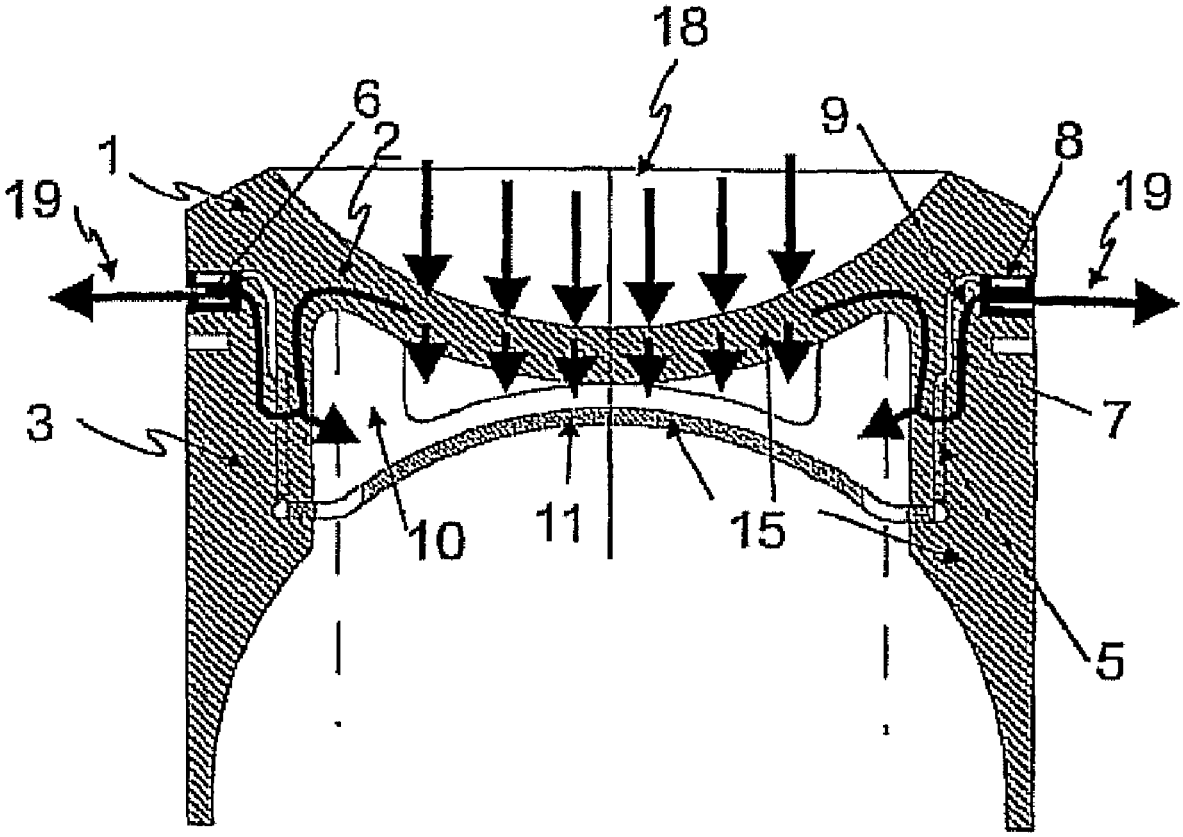
FIG. 5, a distribution of a heat flow in a piston.

FIG. 5 shows a distribution of a heat flow in a piston corresponding to the first piston shown in FIG. 1. A heat flow 18 introduced into a piston head 2 during a fuel combustion process is prevented by a gap 7 from flowing off via a piston ring carrier 6 with piston ring, not shown here, held therein, and into the associated cylinder, likewise not shown here. Moreover the heat flow is prevented by a thermally insulating ring 8 having a markedly smaller thermal conductivity than that of the light metal alloy 15 used for constructing the piston from flowing off via piston ring carrier 6. Heat flow 18 is preferably dissipated into an oil-cooling space 10, which is formed by a metal sheet 11 placed underneath the piston head. A heat flow 19 flowing off via piston ring carrier 6 is forced by means of gap 7 and thermally insulating ring 8 to follow a heat path through the connection 5 between an upper part 1 and a lower part 3 of the piston.

The invention claimed is:

1. A piston for an internal combustion engine, comprising: an upper part (1) having a piston head (2) and a lower part (3), each made of a light metal alloy (15), which are connected to one another such that at least one insulating element in the form of a gap is present between lower part (3) and upper part (1), adjacent to which at least one piston ring carrier (6) holding at least one piston ring and made of a material different from that of upper part (1) and lower part (3), in particular of steel or grey cast iron, is arranged as a component.

2. The piston according to claim 1, wherein said light metal alloy (15) comprises aluminum and/or magnesium and/or beryllium.

3. The piston according to claim 1, wherein at least one thermally insulating ring (8) is arranged between said piston ring carrier (6) and said upper part (1) and/or said lower part (3).

4. The piston according to claim 1, wherein a thermally insulating ring (8) is manufactured from titanium.

5. The piston according to claim 1, wherein a thermally insulating ring (8) is manufactured from a ceramic.

6. The piston according to claim 1, wherein said upper part (1) is screwed to said lower part (3).

7. The piston according to claim 1, wherein said upper part (1) is welded to said lower part (3), or a subsequently welded threaded connection is used.

8. The piston according to claim 1, further comprising a cooling chamber through which a coolant flows, whose lower delimitation on a side of said piston head (2) facing away from a combustion space is a delimiting element, in particular, a metal sheet (11), arranged below it.

9. The piston according to claim 8, wherein said cooling chamber is in one piece.

10. A method for influencing a heat dissipation of a piston for an internal combustion engine, said method comprising the steps: providing an upper part (1) having a piston head (2) and a lower part (3), each part made from a lightweight construction alloy (15); preventing a heat flow introduced in a combustion process into the piston head (2) by means of at least an insulating element, in particular a gap (7), in a piston, between the upper part (1) and the lower part (3), from flowing off via at least one piston ring carrier (6) with at least one piston ring held therein into a cylinder associated with the piston.

11. The method according to claim 10, wherein the heat flow introduced into the piston head (2) is prevented by means of at least one thermally insulating ring (8) from flowing off via at least one piston ring carrier (6) with at least one piston ring held therein into a cylinder associated with the piston.

12. The method according to claim 10, wherein at least a part of the heat flow introduced into the piston head (2) is led by means of the insulating element, in particular gap (7), into an oil-cooling space arranged underneath the piston head (2).

13. A method for influencing a heat dissipation of a piston for an internal combustion engine, said method comprising the steps: providing an upper part (1) and a lower part (3), each part made from a lightweight construction alloy (15); preventing a heat flow introduced in a combustion process into a piston head (2) by means of at least an insulating element, in particular a gap (7), in a piston, between the upper part (1) and the lower part (3), from flowing off via at least one piston ring carrier (6) with at least one piston ring held therein into a cylinder associated with the piston;

wherein the heat flow introduced into the piston head (2) is prevented by means of at least one thermally insulating ring (8) from flowing off via at least one piston ring carrier (6) with at least one piston ring held therein into a cylinder associated with the piston.

14. The method according to claim 13, wherein at least a part of the heat flow introduced into the piston head (2) is led by means of the insulating element, in particular gap (7), into an oil-cooling space arranged underneath the piston head (2).

15. A piston for an internal combustion engine, comprising: an upper part (1) having a piston head (2) and a lower part (3), said upper part (1) screwed to said lower part (3) and each made of a light metal alloy (15), which are connected to one another such that at least one insulating element is present between lower part (3) and upper part (1), adjacent to which at least one piston ring carrier (6) holding at least one piston ring and made of a material different from that of upper part (1) and lower part (3), in particular of steel or grey cast iron, is arranged as a component.

16. The piston according to claim 15, wherein said light metal alloy (15) comprises aluminum and/or magnesium and/or beryllium.

17. The piston according to claim 15, wherein the insulating element is a gap (7).

18. The piston according to claim 15, wherein at least one thermally insulating ring (8) is arranged between said piston ring carrier (6) and said upper part (1) and/or said lower part (2).

19. The piston according to claim 15, wherein a thermally insulating ring (8) is manufactured from titanium.

20. The piston according to claim 15, wherein a thermally insulating ring (8) is manufactured from a ceramic.

21. The piston according to claim 15, wherein said upper part (1) is welded to said lower part (3), or a subsequently welded threaded connection is used.

22. The piston according to claim 15, further comprising a cooling chamber through which a coolant flows, whose lower delimitation on a side of a piston head (2) facing away from a combustion space is a delimiting element, in particular, a metal sheet (11), arranged below it.

23. The piston according to claim 22, wherein said cooling chamber is in one piece.

* * * * *